US009063517B1

(12) United States Patent
O'Neil

(10) Patent No.: US 9,063,517 B1
(45) Date of Patent: Jun. 23, 2015

(54) DEVICE FOR PRESSING BACK TO A WATCH WITHOUT REMOVING WRIST BAND

(71) Applicant: John J. O'Neil, Palm Harbor, FL (US)

(72) Inventor: John J. O'Neil, Palm Harbor, FL (US)

( * ) Notice: Subject to any disclaimer, the term of this patent is extended or adjusted under 35 U.S.C. 154(b) by 0 days.

(21) Appl. No.: 14/445,106

(22) Filed: Jul. 29, 2014

(51) Int. Cl.
*G04D 1/10* (2006.01)
*G04D 3/00* (2006.01)
*G04D 3/06* (2006.01)

(52) U.S. Cl.
CPC ..... *G04D 1/10* (2013.01); *G04D 3/0066* (2013.01); *G04D 3/067* (2013.01)

(58) Field of Classification Search
CPC ..... G04D 3/067; G04D 1/10; G04D 3/0066; Y10T 29/5397; Y10T 29/5347; Y10T 29/53909; Y10T 29/53943
USPC ..... 100/230, 231, 234, 243, 265, 266, 293; 29/231, 232, 269, 270, 278, 281.3, 29/807; 81/6; 968/684, 685, 736, 742
See application file for complete search history.

(56) References Cited

U.S. PATENT DOCUMENTS

| | | | | | |
|---|---|---|---|---|---|
| 1,344,700 | A | * | 6/1920 | Loomis | 29/807 |
| 2,050,335 | A | * | 8/1936 | Junod | 29/807 |
| 2,128,659 | A | * | 8/1938 | Mintz | 81/6 |
| 2,357,904 | A | * | 9/1944 | Mulcrone | 264/249 |
| 2,613,494 | A | * | 10/1952 | Dinstman | 368/292 |
| 2,671,945 | A | * | 3/1954 | Kretzer | 29/10 |
| 3,848,484 | A | | 11/1974 | Fried | |
| 3,917,106 | A | | 11/1975 | Bargetzi | |

OTHER PUBLICATIONS

Cas-Ker: Update article on Best Values for the Jeweler & Watchmaker dated May/Jun. 2014, vol. 900.107; entire document.

* cited by examiner

*Primary Examiner* — Jimmy T Nguyen
(74) *Attorney, Agent, or Firm* — Allen Dyer Doppelt Milbrath & Gilchrist

(57) ABSTRACT

A watch press is provided with a press block for pressing the backs onto wristwatches. The press block defines a clearance through which a watch band can be routed while pressing a back to the attached watch. The press block can be generally U-shaped with the clearance defined between upper and lower members thereof.

9 Claims, 3 Drawing Sheets

DEVICE FOR PRESSING BACK TO A WATCH WITHOUT REMOVING WRIST BAND

FIELD OF THE INVENTION

The invention relates to a device that is used in combination with a watch press similar to crystal presses and appropriate dies, to press and secure the back of a wristwatch after installing a battery or cleaning the wristwatch.

BACKGROUND OF THE INVENTION

Crystal presses are used to press plastic or glass crystals into the bezels of watches, including wristwatches. They are also used by watchmakers and most jewelry stores to press on the backs of watches after installing a battery and/or cleaning the watch.

All watchmakers have crystal presses. They've been around since the use of plastic crystals began. Plastic crystals, which are rarely used now, and glass crystals, which are used more today, can be put in with the same press by changing the different dies to fit a variety of cases.

The backs of watches are secured three ways: by screw-on, with screws around the edge, or by snap-on. The typical crystal press is used more today by jewelry stores to press on the backs after opening the case in order to perform a function such as changing the battery, and cleaning or repairing the watch. Since most presses are crystal presses, they allow the watch to be put into the press, dial side up, and the band to go under the press out of the way. After you change a battery, you must close the back of the case. If you cannot do it by hand, a press must be used. The watch must be put into the press dial side down with the back facing up. This is done in order to see that the back of the watch has been aligned with the back of the watch case so no damage is done when pressure is applied by the press.

When the watch is placed dial side down in the crystal presses used today, there is no place for the watch band to go. It will hit the top part of the press and not allow the watch case to be put flat into the press. If the band is flexible, there is no problem. However, if it is a band that cannot—be bent side to side, it will have to be removed from the watch. Some watch bands have spring bars which can get lost when removed and then need to be replaced; but more and more watches have pins that are pressed in. These pins have to be driven out with a punch and hammer and then be driven back in after the back has been pressed on.

SUMMARY OF THE INVENTION

The present invention overcomes the aforementioned issues raised related to the wrist band. The present invention includes a press block, and associated press, that allows the watch to be used in the press dial side up or dial side down without removing the band, thereby saving time and not damaging the watch.

According to an embodiment of the present invention, a press block is for use with a watch press used for attaching crystals and backs to wrist watches. The watch press has on an upper side thereof a vertically oriented push rod operable by an attached pivotable handle, wherein when the push rod is pushed down with the handle a resultant compressed spring returns the handle to an upper position at rest, and the watch press having on a bottom side of said watch press means for attaching a watch case support die configured to support the watch case when a watch crystal or watch back is being pressed onto the watch. The press block comprises a generally U-shaped block, wherein an upper member of the U-shaped block is spaced-apart from a lower member of the U-shaped block a distance sufficient to slide a wrist band of a watch, and the upper member of the U-shaped block having means for securing said press block to said push rod, and the lower member of the U-shaped block having means on an underside of said lower member for attaching a die configured for pressing a back to a back side of the watch case.

According to another aspect of the present invention, a watch press comprises a press body, a lower die mounted to the press body, an upper die positioned over the lower die and movable theretowards along a die axis, a press block carrying the upper die, and a push rod carrying the press block and slidably mounted to the press body. A clearance is defined over press block intersecting the die axis, the clearance allowing a wristband of a watch located between the upper and lower dies to be passed therethrough without interference from the push rod.

These and other objects, aspects and advantages of the present invention will be better appreciated in view of the drawings and following detailed description of preferred embodiments.

DETAILED DESCRIPTION OF PREFERRED EMBODIMENTS

Figure 1:
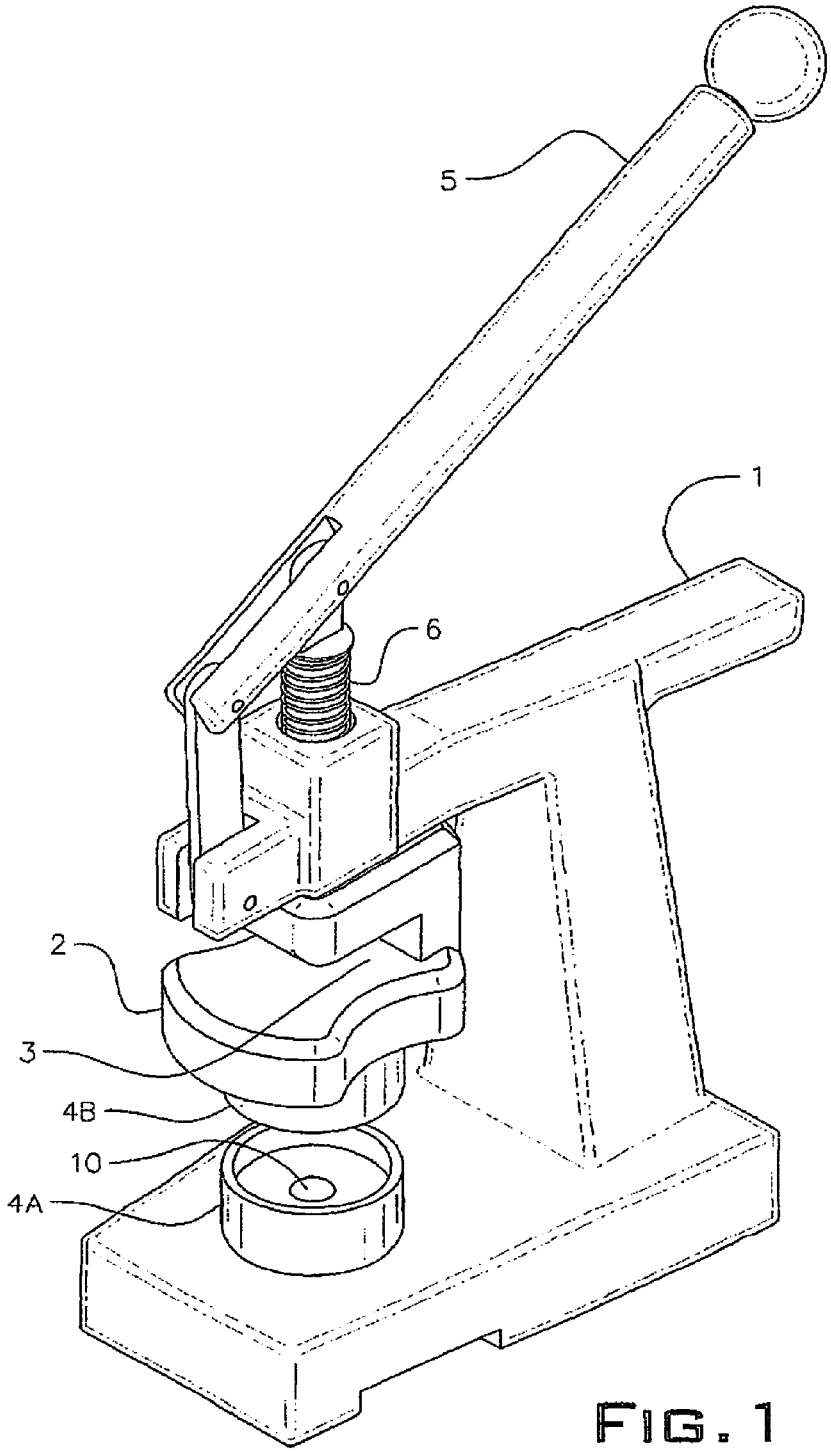
FIG. 1 is a perspective view of a watch press with a press block according to an embodiment of the present invention, without a watch in place.
Figure 2:
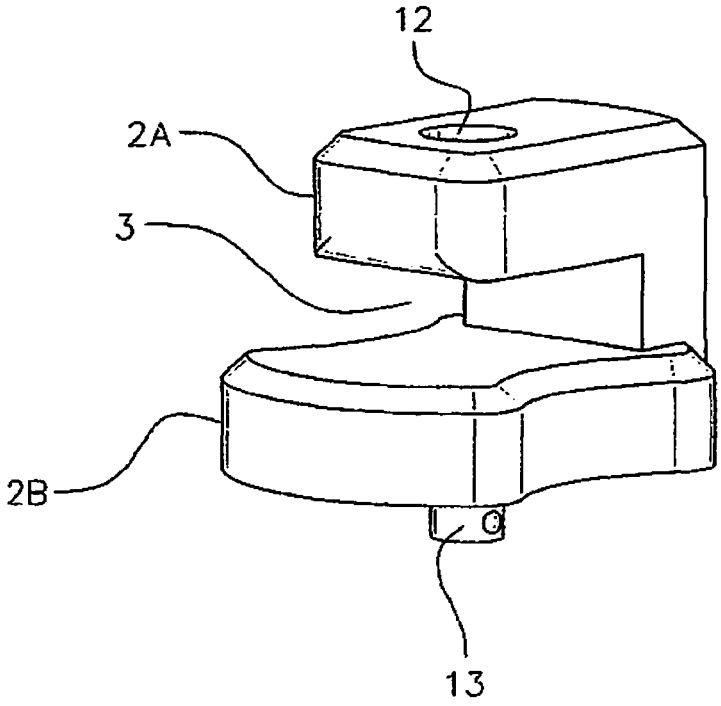
FIG. 2 is a perspective view of the press block of FIG. 1.
Figure 3:
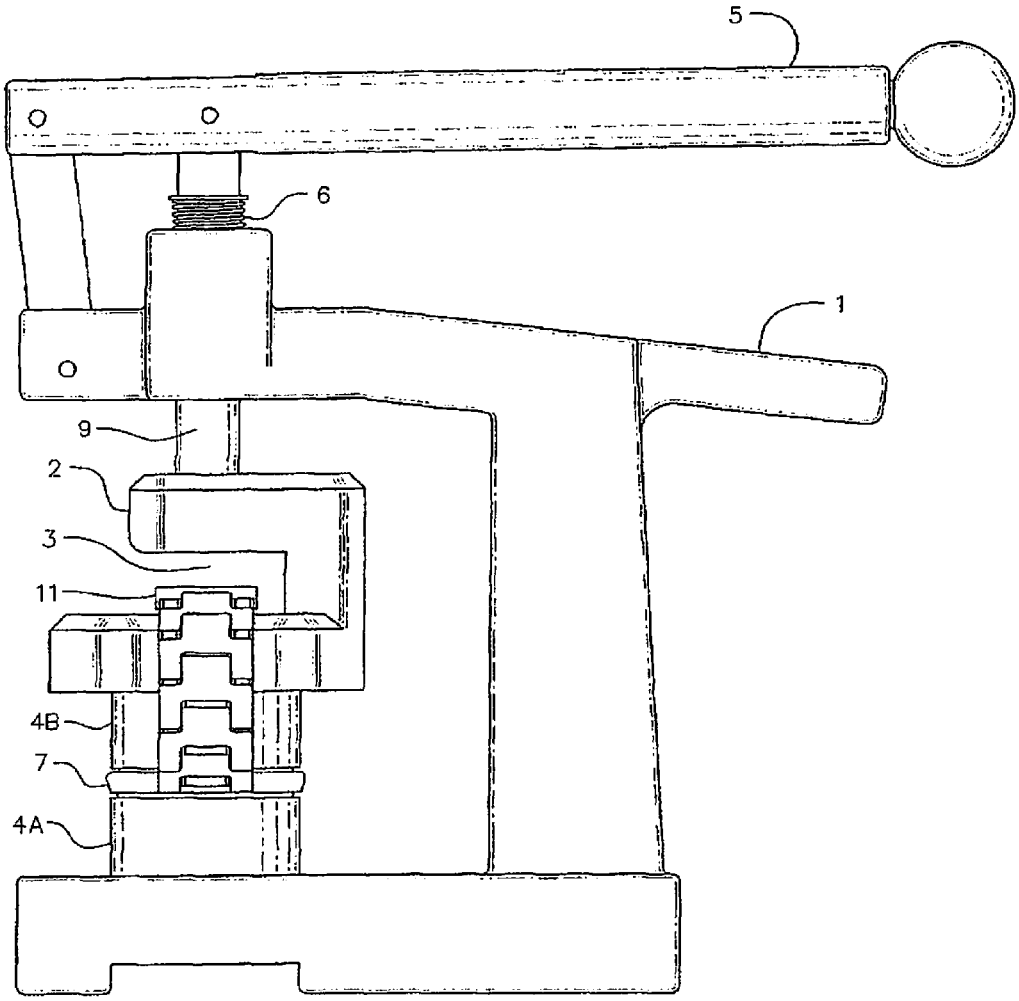
FIG. 3 is a side view of the watch press and press block of FIG. 1 in use compressing the back of a watch in the casing with the wrist band of the watch placed in a non-interfering mode within a clearance of the U-shaped press block.

Referring to FIGS. 1-3, according to an embodiment of the present invention, a watch press includes press body 1 and a press block 2 that is used in combination with the press body 1 for attaching crystals and backs to wrist watches/watch cases 7. Watch presses typically have on an upper side of the watch press a vertically oriented push rod 9 operable by an attached pivotable handle 5 wherein when the push rod 9 is pushed down with the handle 5, a return spring 6 is resultantly compressed and returns the handle 5 to an upper position at rest. The bottom side of the press body 1 further has means 10 for attaching a watch case support die 4A configured to support the watch case 7 when a watch crystal or watch back is being pressed onto the watch case 7. The attachment means 10 can be accomplished in a number of ways known in the art such as a recessed portion in which the die 4A is placed or snap-on type fixtures. A preferred more commonly used method is similar to that depicted in FIG. 1 where the die has an aperture which is engaged with a mating vertically oriented pin or dowel. The engagement method utilized must be sufficient to maintain the die 4A stable while the watch case 7 is resting on the support die 4A.

The press block 2 comprises a generally U-shaped block. The upper member 2A of the U-shaped block is spaced-apart from the lower member 2B of the U-shaped block to define a clearance 3 of a distance sufficient to slide a wrist band 11 of a watch 7 therethrough. The upper member 2A of the U-shaped block comprises means 12 for securing the press block 2 to the push rod 9. Again the means 12 for securing the press block 2 to the push rod 9 can be done in a number of ways known in the art such as screw-on connectors however the preferred method is as depicted from FIGS. 1 and 2 where the push rod 9 is engaged with a mating recessed hole or aperture 12 on top of the upper side 2A of the press block 2. The hole 12 has a depth and cross-dimension sufficient to secure the press block 2 to the push rod 9.

The lower member 2B of the U-shaped block 2 further has means 13 on an underside of the lower member 2B for attaching a die 4B configured for pressing a back to a back side of the watch case 7. There are several methods known in the art to accomplish means 13, which are similar to the aforementioned methods for attaching dies or the press block described above, a preferred method is as depicted in FIG. 2 where a dowel pin or member 13 extends from the press block 2 lower member 2B and is configured to be tightly engaged with a mating recessed aperture/receiver (not shown) in die 4B. The engagement can also be made with a spring ball plunger type engagement similar to that used with socket set wrenches. The die 4B overlies the die 4A and is coaxial therewith along a die axis, which intersects the clearance 3. In the depicted embodiment, the push rod 9 is also coaxial with the die axis.

The press block 2 can be made from a variety of materials including any one of cast iron, steel, aluminum, hard plastic such as composite polymeric material, and any other material that can stand the pressure and not deform while pressing the back of a watch onto the watch case.

Most existing watch presses are currently made in China and the spacing may not have sufficient spacing to utilize the generally U-shaped press block 2. Accordingly, a new press body 1 could be purpose-made to utilize the press block 2.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A watch press comprising:

a press body;

a lower die mounted to the press body;

an upper die positioned over the lower die and movable theretowards along a die axis for pressing a watch back onto a watch case;

a press block carrying the upper die; and a push rod carrying the press block and slidably mounted to the press body;

wherein a clearance is defined between upper and lower members of the press block, the clearance intersecting the die axis and allowing a wristband of a watch located between the upper and lower dies to be passed therethrough without interference from the push rod.

2. The watch press of claim 1, wherein the press block is generally U-shaped.

3. The watch press of claim 2, wherein the push rod is coaxial with the die axis.

4. The watch press of claim 1, further comprising a handle pivotably attached to an upper end of the push rod and operable via the push rod to move the press block and upper die toward the lower die.

5. The watch press of claim 4, further comprising a push rod return spring coupled with the push rod such that the return spring is compressed by movement of the push rod, press block and upper die toward the lower die, decompression of the spring when the handle is released causing the push rod, press block and upper die to move away from the lower die.

6. The watch press of claim 1, wherein the lower die is a stationary watch case support die.

7. The watch press of claim 1, wherein the lower die is removable from the press body.

8. The watch press of claim 1, wherein the upper die is removable from the press block.

9. The watch press of claim 1, wherein the press block is removable from the push rod.

* * * * *